United States Patent [19]

Studer

[11] Patent Number: 5,074,378

[45] Date of Patent: Dec. 24, 1991

[54] MULTI-PURPOSE LADDER WITH LOCKING MECHANISM FOR EXTENDIBLE LEGS

[75] Inventor: Lewis O. Studer, Barberton, Ohio

[73] Assignee: Kaddi Corporation, North Lawrence, Ohio

[21] Appl. No.: 636,896

[22] Filed: Jan. 2, 1991

[51] Int. Cl.[5] ..... E06C 7/44

[52] U.S. Cl. ..... 182/201; 182/166; 182/209

[58] Field of Search ..... 182/201, 202, 204, 211, 182/166, 167

[56] References Cited

U.S. PATENT DOCUMENTS

| | | | |
|---|---|---|---|
| 2,366,829 | 1/1945 | Biery | 182/202 |
| 3,374,860 | 3/1968 | Stewart | 182/204 |
| 4,014,406 | 3/1977 | Easton | 182/204 |
| 4,155,422 | 5/1979 | Larson | 182/166 |
| 4,627,516 | 12/1986 | Studer | 182/202 |

*Primary Examiner*—Reinaldo P. Machado

*Attorney, Agent, or Firm*—Renner, Kenner, Greive, Bobak, Taylor & Weber

[57] ABSTRACT

A ladder with extendible legs that may be individually and selectively, secured in the desired extent of protraction by a relatively uncomplicated locking mechanism. The locking mechanism may be incorporated in a ladder having at least a pair of support legs with an extension leg carried by, and slidable axially along, each support leg. A reaction surface is presented from each support leg. A pair of locking cam surfaces is also presented from each support leg. The locking cam surfaces are disposed in spaced opposition to each reaction surface. An engaging plate is presented from each of the extension legs. The engaging plate is slidably interposed between the reaction surface and the opposed locking cam surfaces. A locking member is, in turn, operatively disposed between the engaging plate and the opposed locking cam surfaces. Each locking member is movable along at least one of the locking cam surfaces selectively to wedge the engaging plate against the reaction surface in order axially to secure the extension leg at the desired position along the axial extent of the support leg. The locking member is also movable selectively to release the extension leg for axial movement along the support leg. A linking mechanism is provided to control movement of the locking member in order selectively to secure or release each extension leg for retraction and/or protraction.

24 Claims, 5 Drawing Sheets

MULTI-PURPOSE LADDER WITH LOCKING MECHANISM FOR EXTENDIBLE LEGS

TECHNICAL FIELD

The present invention relates generally to ladders. More particularly, the present invention relates to ladders with extendible legs. Specifically, the present invention relates to ladders which offer the ability selectively to alter the length of the individual, extendible legs for use on uneven, non-level, or otherwise irregular terrain and to lock the individual, extendible legs at the desired length.

BACKGROUND OF THE INVENTION

One of the difficulties commonly encountered when using a ladder is finding an appropriately located section of ground, or other surface, on which to place the ladder so that it can be safely used. Far too often the surface at the desired location is inappropriately sloped, or one leg of the ladder tends to sink into the surface more readily than one or more of the other legs. Unfortunately, when the user of a ladder is faced with an undesirable surface the tendency is to employ some makeshift "propping device" to shore-up one or more of the legs in order to achieve, and hopefully maintain, at least a modicum of plumb to the ladder.

Poorly selected "propping devices" often result in either damage or injury to the ladder and/or its user. These harsh consequences have heretofore prompted the development of ladders having extendible legs which incorporate some locking arrangement. The intended result to be achieved by the use of extendible legs is to effect facile adjustment to the length of each leg and thereby accommodate a wide variety of unfavorable surfaces which might reasonably be expected to be encountered. However, there always appears to be room for improvement.

Perhaps one of the most successful of the prior art extension leg locking devices is disclosed in my prior U.S. Pat. No. 3,016,103. That patent discloses a leg extension apparatus which utilizes a ratchet-type locking mechanism to allow the legs of the ladder to extend downwardly to the surface, or surfaces, on which the ladder is to be placed, and then be able to lock the extended legs in the position chosen so that the ladder will be relatively plumb, irrespective of the surface on which the ladder is resting. However, when the locking mechanism is released the ratchet permits the legs to retract for convenient storage. Unfortunately, the aforesaid ratchet type locking mechanism is rather complicated, and as a result is more difficult to use, is slightly more prone to malfunction, and is, therefore, somewhat more difficult to manufacture. Moreover, the relative complexity of the ratchet type locking mechanism also serves to make it somewhat unreliable.

The tendency toward occasional unreliability occurs because the connection between the fixed legs and the extension legs is effected by a ratchet-and-tooth configuration. As such, the ratchet must align directly with a tooth in order to effect the best possible gripping interaction therebetween. Occasionally a ratchet may not fully engage the recess between two successive teeth, but may, instead, catch on the edge, or apex, of a tooth, giving the impression that it is securely seated, but being unexpectedly able to disengage as soon as weight is applied, or shortly thereafter. When such an arrangement does slip, the ratchet member will generally engage within that recess between the next two successive teeth. This prevents the ladder from totally collapsing. Nevertheless, the ladder may jar the user sufficiently to cause a loss of balance that could result in a fall.

Other endeavors to provide locking mechanisms which permit selective adjustability for the extendible legs of a ladder allow the extension legs to protract freely when the ladder is not subjected to any load and which preclude the extension legs from retracting when the ladder must support the combined weight of the ladder and the user. That is, when the ladder is resting on firmly-planted extension legs the entire weight of the ladder and the user serve to actuate the locking mechanism and thereby prevent any further movement of the extension legs. This device is not ideal because it possesses an inherent tendency to release its locking effect when the weight applied to the ladder is partially, or even momentarily, reduced beyond a critical value. Accordingly, if a ladder having the latter described mechanism is bumped or jarred, or the user loses his balance while on the ladder, the load can be momentarily reduced to the point that the locking mechanism may release, with disastrous results.

SUMMARY OF THE INVENTION

It is, therefore, a primary object of the present invention to provide an improved locking mechanism for the extendible legs of a ladder.

It is another object of the present invention to provide a locking mechanism for a ladder, as above, which will positively lock the legs against retraction from their extended position until the locking mechanism is selectively released.

It is a further object of the present invention to provide a locking mechanism for a ladder, as above, which employs actuating means for selectively engaging and disengaging the locking mechanism.

It is still another object of the present invention to provide a locking mechanism for a stepladder, as above, wherein movement of the bucket tray will actuate the locking mechanism to secure the legs in their selectively extended position.

It is an even further object of the present invention to provide a locking mechanism for a step ladder, as above, which utilizes a mechanism that will actuate the locking mechanism to secure the extension legs in their retracted position in response to folding the stepladder for storage.

It is yet a further object of the present invention to provide a locking mechanism, as above, which is relatively inexpensive to manufacture and maintain.

These and other objects of the invention, as well as the advantages thereof over existing and prior art forms, which will be apparent in view of the following detailed specification, are accomplished by means hereinafter described and claimed.

In general, the combination of a ladder having extendable legs and a locking mechanism embodying the concepts of the present invention utilizes at least a pair of support legs with an extension leg carried by, and slidable axially along, each support leg. The locking mechanism employs a reaction surface that is presented from each support leg. A pair of locking cam surfaces is also presented from each support leg. The locking cam surfaces are disposed in spaced opposition to the reaction surface.

An engaging plate is presented from each of the extension legs. The engaging plate is slidably interposed between the reaction surface and the opposed locking cam surfaces. A locking member is, in turn, operatively disposed between the engaging plate and the opposed locking cam surfaces. The locking member is movable along at least one of the locking cam surfaces selectively to wedge the engaging plate against the reaction surface in order axially to secure the extension leg at the desired position along the axial extent of the support leg. The locking member is also movable selectively to release the extension leg for axial movement along the support leg.

Actuating means are provided to control movement of the locking member in order selectively to secure or release the extension leg.

One exemplary embodiment, and two alternative variations of certain components, of an improved locking mechanism embodying the concepts of the present invention that are particularly adapted for use with a ladder having extendible legs are described in sufficient detail herein to effect a full disclosure of the subject invention. The locking mechanism is, however, described without attempting to show all of the various forms and modifications in which the invention might be embodied; the invention being measured by the appended claims and not by the details of the specification.

DESCRIPTION OF AN EXEMPLARY EMBODIMENT

Figure 1:
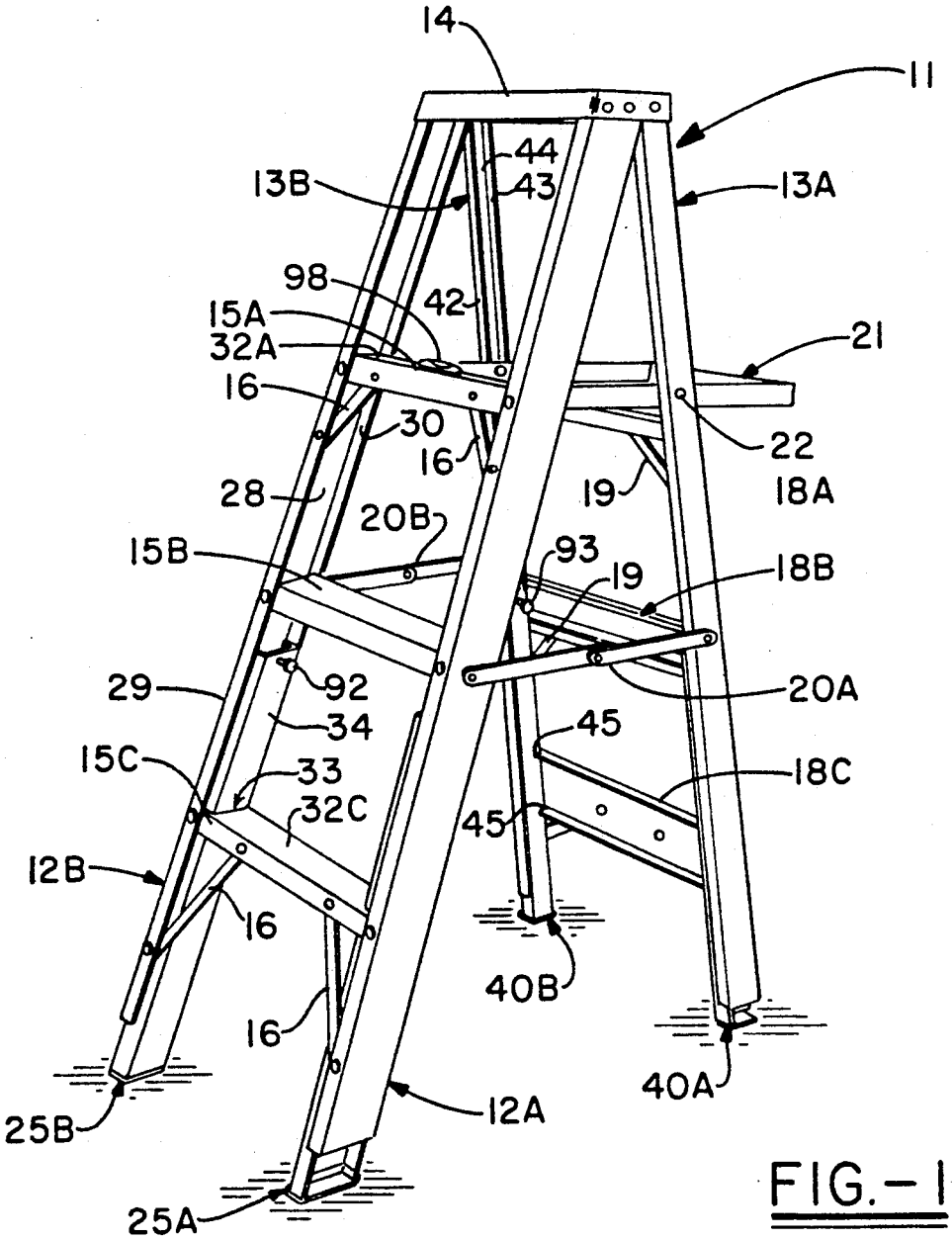
FIG. 1 is a frontal perspective of a step ladder having extendible legs and incorporating a locking mechanism embodying the concepts of the present invention.

One representative form of a locking mechanism embodying the concepts of the present invention is designated generally by the numeral 10 (see FIGS. 2 and 5 in particular) on the accompanying drawings and is depicted operatively incorporated in a ladder 11. With particular reference to FIG. 1, the representative ladder 11 has a pair of front and a pair of back, or rear, support legs 12 and 13, respectively. The pairs of front and back legs 12 and 13 are laterally spaced. As such, there are right and left, front support legs 12A and 12B, respectively, as well as right and left back support legs 13A and 13B.

As prefaced by the preceding paragraph, and as will continue in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are two front support legs which are generally identified by the numeral 12, but the specific, individual legs are, therefore, identified as 12A and 12B in the specification and on the drawings. This same suffix convention shall be employed throughout the specification.

Both the front support legs 12 and the back support legs 13 are operatively connected, in a well known manner, to a laterally extending top support 14. A plurality of steps 15 are secured to extend laterally between the right and left, front support legs 12A and 12B. As shown, a representative ladder 11 may have three steps 15A, 15B and 15C. For structural stability one may utilize a plurality of haunched braces 16 which extend diagonally between each step 15 and the support legs 12A and 12B.

Horizontal braces 18 are similarly mounted between the right and left, back support legs 13A and 13B to provide lateral rigidity thereto in a manner similar to the stability imparted to the front support legs 12 by the steps 15. In the representative embodiment depicted, three horizontal braces 18A, 18B and 18C are employed, and each horizontal brace 18 may, if desired, similarly employ haunched braces 19 which extend diagonally between each horizontal brace 18 and the rear support legs 13A and 13B. As shown in FIG. 1, haunched braces 19 may be employed in conjunction with horizontal braces 18A and 18B. However, the vertical dimension of horizontal brave 18C is such that a haunched brace is not required. The steps 15 and the horizontal braces 18, together with the haunched braces 16 and 19, thus combine to impart stability to the overall structure of the ladder 11.

A pair of articulating arms 20A extend between the right front and right back support legs 12A and 13A, and a pair of articulating arms 20B similarly extend between the left front and the left back support legs 12B and 13B. Also mounted from the back support legs 13A and 13B, but cooperatively interactive with the front support legs 12A and 12B, is a bucket tray 21 that is tiltably mounted from the back support legs 13 by a pivot pin 22 or any other similar connector. The bucket tray 21 is releasably, and cooperatively, interactive with the step 15A by means of notch 23, as will be hereinafter more fully described.

Figure 3:
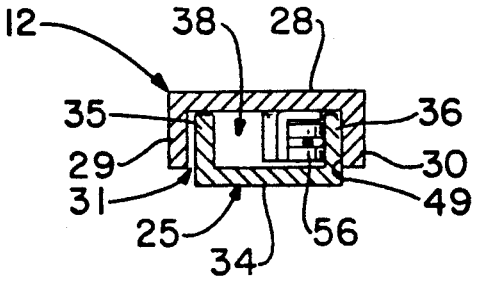
FIG. 3 is an enlarged, transverse section which appears on the same sheet of drawings as FIG. 1 and which is taken substantially along line 3—3 of FIG. 2 to depict a typical relationship between an extension leg and a front support leg.

Front extension legs 25 may be operatively mounted on the front support legs 12 of the ladder 11 in any manner which allows each extension leg 25 to slide axially along the respective front support leg 12 with which it interacts. In the exemplary embodiment depicted the front support legs 12 are, as best seen in FIG. 3, preferably channel-shaped so that each support leg 12 has a wed wall 28 with a pair of flanges 29 and 30 extending perpendicularly outwardly from the wed wall 28 along the parallel edges of the web wall 28. The flanges 29 and 30 are, therefore, disposed in parallel, lateral relation, one with respect to the other. The web wall 28 and the two flanges 29 and 30 thus define three sides of a recess 31 in each of the front support legs 12.

The respective recesses 31 within each of the two laterally displaced front support legs 12A and 12B are preferably disposed in opposition inasmuch as that disposition allows the steps 15 to be secured to the laterally spaced flanges 29 and 30 on each of the front support legs 12A and 12B. So secured, each side of the step surface 32C, at least on step 15C, may be provided with a niche 33, as best seen in FIG. 1, so as not to restrict the ability of the extension legs 25A and 25B to slide within the recess 31 provided in each front support leg 12A and 12B, and yet the niches 33 serve as the means by which to retain the extension legs 25 within the appropriate recess 31. Accordingly, at least step 15C serves as the retaining means by which the extension legs 25A and 25B can be maintained within the recesses 31 of the respective front support legs 12A and 12B. It should be understood, however, that the particular retaining means employed is not critical to the proper operation of the ladder 11. In fact, a combination of retaining means may be employed, as desired.

With continued reference to FIG. 3, the front extension legs 25 may be shaped similarly to the front support legs 12. That is, each extension leg 25 may have a web wall 34 with a pair of flanges 35 and 36 extending perpendicularly outwardly from the web wall 34 along the opposite edges thereof. Although the front extension legs 25 and the front support legs 12 are similarly shaped, the lateral dimension of the web wall 34 is smaller on the extension legs 25 than the dimension of the corresponding web wall 28 of the front support legs 12 in order to permit the front extension legs 25A and 25B to be slidably received within the recess 31 of the respective support legs 12A and 12B. When the extension legs 25 are each received within the appropriate recess 31, the extension legs 25 are disposed relative to the respective front support legs 12 such that the extension legs 25 cooperate with the support legs 12 to delineate a rectilinear lock cavity 38. Each lock cavity 38 is bounded by the web wall 28 of one support leg 12 and the opposed web wall 34 and the two flanges 35 and 36 of the extension leg 25 received within the recess 31 of that support leg 12. The depth of the lock cavity 38 may, by virtue of the structural configuration of the support and extension legs 12 and 25 heretofore described, be determined by the distance which the flanges 35 and 36 extend outwardly from the web wall 34 of the extension legs 25. When the flanges 35 and 36 slidably engage web wall 28 the lock cavity 38 is fully delineated.

Figure 4:
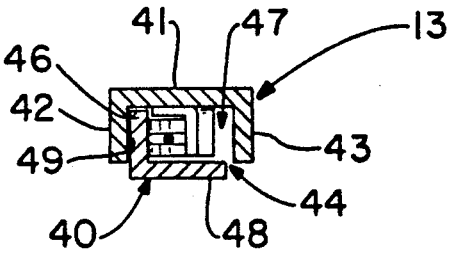
FIG. 4 is an enlarged, transverse section which also appears on the same sheet of drawings as FIG. 1 and which is taken substantially along line 4—4 of FIG. 2 to depict a typical relationship between an extension leg and a rear support leg.

With particular reference to FIG. 4, the back support legs 13 are also provided with extension means in the nature of extension legs 40 which are mounted for sliding movement along the back support legs 13. The back support legs 13 and back extension legs 40 can be operatively secured together by any means which allows the extension legs 40 to slide axially along the back support legs 13 but which prevents the two from becoming separated. In the exemplary embodiment described herein the back support legs 13 are also preferably channel-shaped so that each leg 13 has a web wall 41 and two flanges 42 and 43 extending perpendicularly outwardly from the parallel edges of the web wall 41. The flanges 42 and 43 are, therefore, also disposed in parallel, lateral relation, one with respect to the other. The web wall 41 and the two flanges 42 and 43 thus define three sides of a recess 44 in each back support leg 13. The back support legs 13A and 13B like the front support legs 12A and 12B may be oriented with the recesses 44 disposed in opposition. As such, the edge portions, such as identified at 45 in FIG. 1, on the horizontal brace 18C may serve as one form of the retaining means by which each of the hereinafter described back extension leg 40 is slidably maintained in the desired position relative to the recess 44 provided by the appropriate back support leg 13.

The back extension legs 40, however, need not be channel-shaped, but may conveniently be in the configuration of an angle iron. That is, the back extension legs 40 may have an L-shaped cross section so that one flange 46 thereof may be disposed within the recess 44 of each back support leg 13 slidably to engage the flange 42 of the back support leg 13 and with the other flange 48 of the extension leg 40 being disposed in spaced, parallel opposition to the web wall 41 of the back support legs 13. The back extension legs 40 and the back support legs 13 also interact to define a generally rectilinear lock cavity 47. Each lock cavity 47 is bounded by the web wall 41 and one flange 43 of the back support leg 13 and the opposed flanges 46 and 48 of the extension leg 40. As will also be hereinafter more fully explained, the locking mechanism 10 is operatively received within the lock cavity 47 to interact between the reaction surface 49 on the flange 42 of the back support leg 13 and the flange 46 of the extension leg 40.

Figure 5:
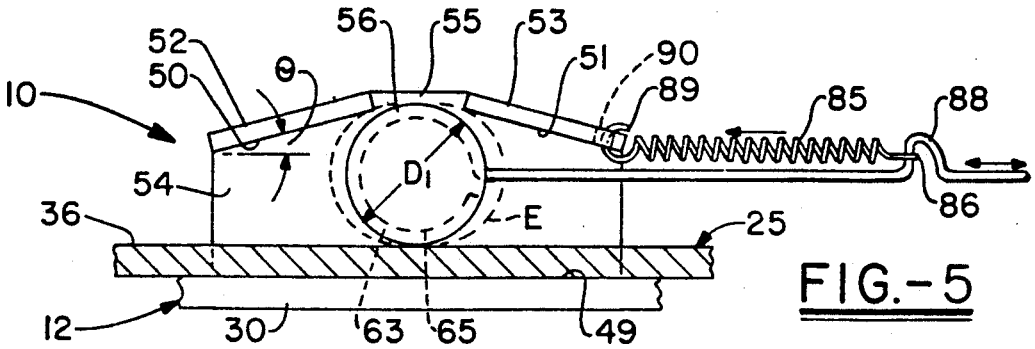
FIG. 5 is an enlarged, elevational view of a typical locking mechanism embodying the concepts of the present invention.

A locking mechanism 10 embodying the concepts of the present invention may be presented from the front and back support legs 12 and 13 to interact with the respective extension legs 25 and 40. With particular reference to FIG. 5, the locking mechanism 10 employs a pair of locking cam surfaces 50 and 51 which taper toward that element of the support legs with which the locking mechanism 10 operatively interacts—viz.: the reaction surface—selectively to lock the extension legs at the desired individual length relative to the support legs by which each extension leg is carried. In the embodiment of the front support legs 12 depicted it has been arbitrarily determined that the reaction surface will comprise the inwardly facing surface 49 on flange 30.

The locking cam surfaces 50 and 51 may be presented from a pair of cam plates 52 and 53, respectively, which may be secured to the web wall 28, or, as shown, the cam plates 52 and 53 may be supported from a mounting arm 54. The mounting arm 54 may be of heavier gauge that the support leg 12 or 13 in order to impart the desired strength to the locking mechanism 10. With specific reference to the front support leg 12, the mounting arm 54 may be secured to the web wall 28, or it may extend outwardly from the flange 30 in substantially parallel relation to the web wall 28. In any event the cam plates 52 and 53 are located in spaced relation to the reaction surface 49 on the flange 30 with the cam surfaces 50 and 51 being disposed in opposition thereto.

Irrespective of how the cam plates 52 and 53 are supported, the cam surfaces 50 and 51 are tapered in such a manner that they extend in substantially opposite directions outwardly from an apex 55 and toward the reaction surface 49 on the front support leg 12. The tapered surfaces 50 and 51 may, as shown, be truncated such that the apex 55 constitutes the imaginary point at which the surfaces 50 and 51 would converge had they not been truncated.

A cylindrical locking member 56 is operatively disposed between the cam surfaces 50 and 51 and the reaction surface 49, and an engaging plate is interposed between the locking member 56 and the reaction surface 49. The engaging plate constitutes the flange 36 on the extension leg 25, and it is the frictional binding of the engaging plate (flange 36) between the locking member 56 and the reaction surface 49 which locks the extension leg 25 axially with respect to the support leg 12.

Figures 6, 7:
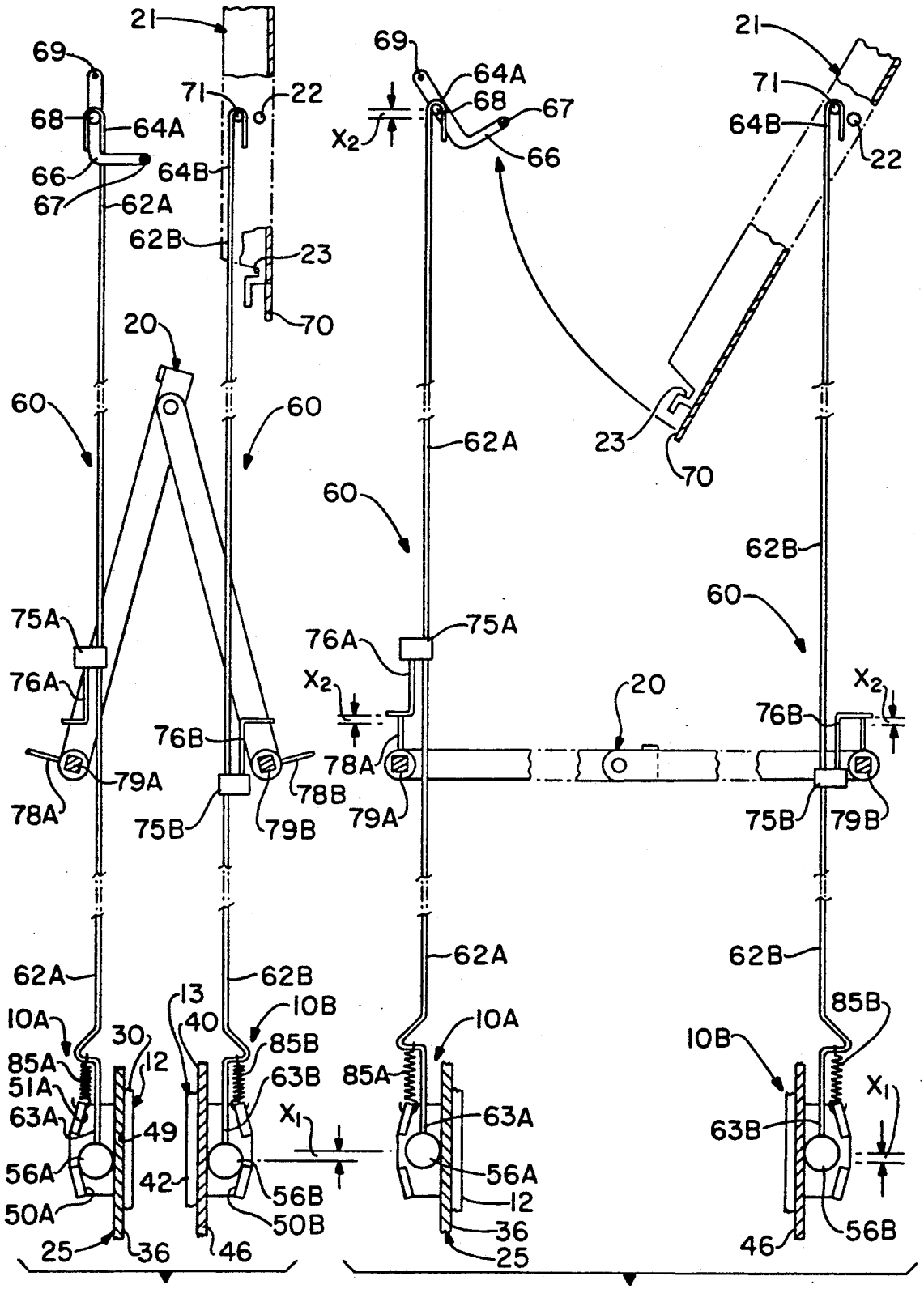
FIG. 6 is a schematic, side elevational view depicting the operative disposition of the locking mechanism, and the link arm actuating means, in the storage mode position whereby the extension legs may readily retract but not extend.
FIG. 7 is a schematic, side elevational view similar to FIG. 6 but depicting the operative disposition of the locking mechanism, and the link arm actuating means, in the leg-adjustment mode position whereby the extension legs may readily retract or extend in order to adjust to the surface on which the ladder is to be used.

The diameter $D_1$ of the cylindrical locking member 56 is such that when the locking member 56 is located substantially between the apex 55 and the reaction surface 49 on flange 30 (as shown in FIGS. 5 and 7) the flange 36 is unrestricted, and the extension leg 25 may freely slide axially along the front support leg 12. With continued reference to FIG. 5, an ellipse "E"—represented in chain line—depicts the range of movement available to the locking member 56 without pinching the flange 36 sufficiently to restrict the axial movement of the extension leg 25 along the front support leg 12 with which it interacts. As such, when the locking member 56 is disposed within the confines of the ellipse "E" the locking mechanism 10 is in the hereinafter more fully described leg-adjustment mode.

It is important to understand that the locking surfaces 50 and 51 taper to such an extent that when the locking cylinder 56 is located at some point along either surface 50 or 51 the locking member 56 will frictionally secure—i.e.: will pinch—the flange 36 (the engaging plate) against the reaction surface 49 on flange 30, as will be hereinafter more fully explained in conjunction with the operational description of the present invention. Typically, the locking surfaces 50 and 51 are tapered at approximately seven degrees, as represented at $\theta$ in FIG. 5 inasmuch as an angular disposition of approximately that magnitude effects an augmentation of the wedging action when the extension leg is urged to move toward the cam surface engaged by the locking member 56 and conversely facilitates the release of the locking member 56, when the extension leg is urged in the opposite direction.

Figure 9:
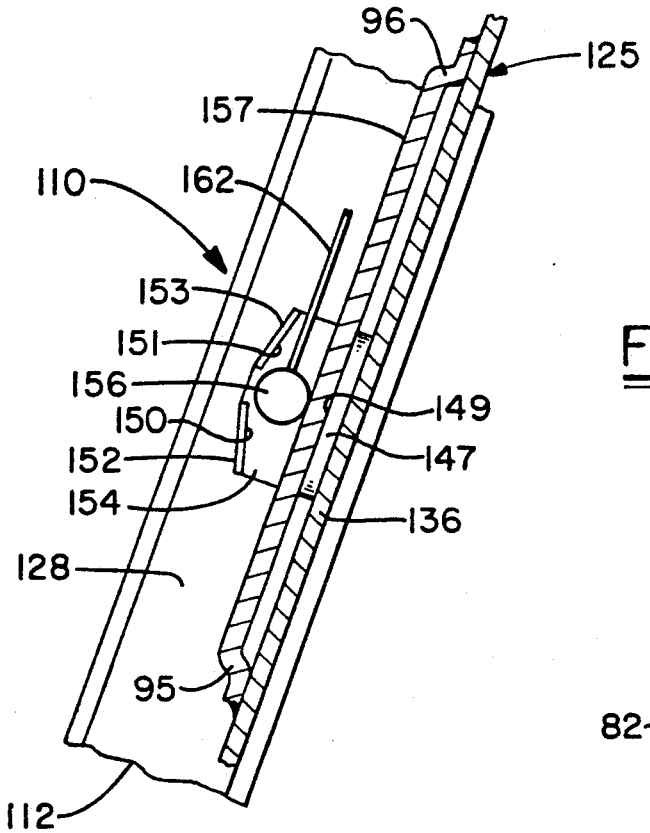
FIG. 9 is an elevational view similar to FIG. 5, partially in section, depicting an alternative embodiment of the locking mechanism.

FIG. 9 discloses an alternative arrangement by which the locking mechanism may operatively interact between a support leg and an extension leg. This arrangement is particularly suited for use with a ladder configuration wherein the gauge and/or type of material used to construct the ladder might permanently deform, or crack, under the concentrated loading applied by the locking member directly against some portion of the extension leg. As such, the alternative locking mechanism 110 may utilize a mounting arm 154 secured, for example, to the web wall 128 of the support leg 112. The mounting arm 154 would present not only the typical cam plates 152 and 153 but also the reaction surface 149 on one side of a shelf 147 which extends perpendicularly outwardly from the mounting arm 154. The flange 136 on the extension leg 125 is slidably received between the shelf 147 and the flange 130 on the support leg 112.

A separate engaging plate 157 is affixed to the flange 136 and is laterally offset therefrom so as to slide across, and remain in contact with, the reaction surface 149 on the shelf 147. As such, the locking member 156 responds to selective, wedging engagement with the cam surface 150 and 151 on the cam plates 152 and 153, respectively, by pinching the engaging bracket 157 between the reaction surface 149 and the locking member 156. As such, the interacting components which lock the extension legs with respect to the appropriate support legs do not include the structure of the ladder legs themselves. Those familiar with the locking mechanism 110 can vary it for use with the rear support and extension legs 13 and 40, respectively, as readily as with the front support and extension legs 12 and 25, or 112 and 125, respectively.

Thus, the effective operation of the locking mechanism 110 need not depend upon the physical characteristics of the materials from which either the support legs or the extension legs are fabricated, but rather only the materials from which the shelf 147, the engaging bracket 157 and the locking member 156 are made.

The locking mechanism 10 also incorporates a linking mechanism 60 that is connected between each locking mechanism 10 employed on the ladder 11 and the actuating members by which the different operating modes of the locking mechanism 10 may be positively selected. In the embodiment depicted in FIGS. 6, 7 and 8 selective movement of the bucket tray 21 changes the locking mechanisms 10A and 10B from the leg-adjustment mode to the leg-locked mode, and vice versa. Accordingly, the bucket tray 21 may, therefore, be designated generally as an actuating member. Similarly, movement of the articulating arms 20 changes the locking mechanisms 10A and 10B from the storage mode to the leg-adjustment mode, and vice versa. Accordingly, the articulating arms 20 may also be designated as actuating members. The details as to the leg-adjustment mode, the leg-locked mode and the storage mode will be hereinafter fully explained in conjunction with the operational description.

Figure 8:
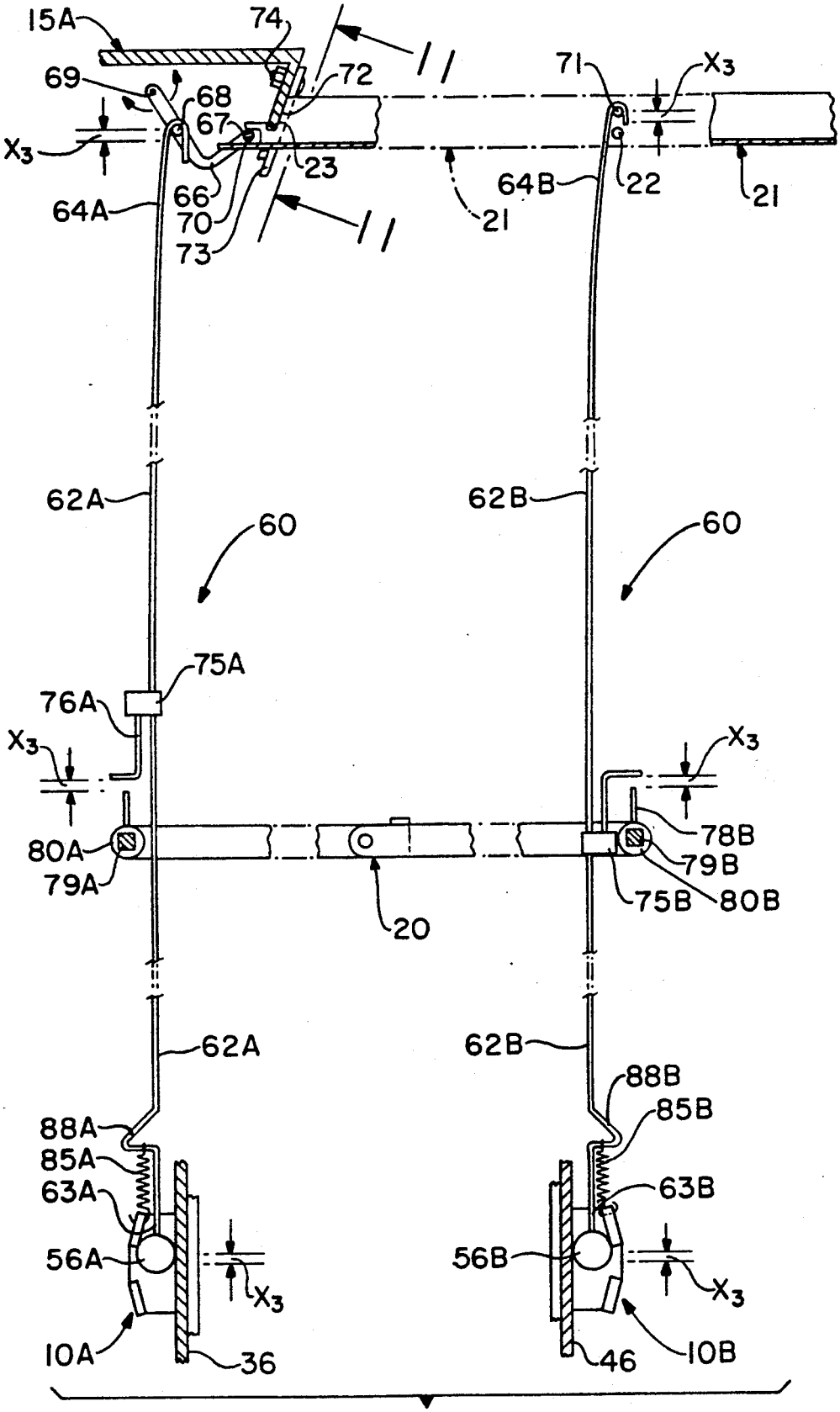
FIG. 8 is a schematic side elevational view similar to FIGS. 6 and 7 but depicting the operative disposition of the locking mechanism, and the link arm actuating means, in the leg-locked mode whereby the extension legs are secured and the ladder is ready to use.

Referring particularly to the aforesaid FIGS. 6 through 8 the linking mechanism 60 is schematically represented. The linking mechanism 60 employs a plurality of link arms 62 which operate primarily to transfer tensile forces between the actuating members and each locking mechanism 10, although in some situations it may be desirable, or necessary, to transfer compressive forces as well—at least one example of which will be hereinafter described. The link arms 62 can be formed from stiff wire, rods or any other arrangement which can provide the ability selectively to transfer at least the tensile, and perhaps the occasional compressive, forces capable of translating each locking member 56 in the manner required to select the desired mode.

As shown, one end 63 of each link arm 62 is fastened to a cylindrical locking member 56, and the other end 64 of each link arm 62 is operatively interactive with an actuating member.

Although there are a number of ways by which the link arms 62 may be secured to the locking members 56, it is preferred that the connection be such as to permit the cylindrical locking member 56 to roll in order to enhance the interaction between the locking member 56 and the cam surfaces 50 and 51. Thus, that end 63 of the link arm 62 operatively secured to the locking member 56 may substantially circumscribe the locking member 56 and be received within an annular groove 65, as represented by the dotted line in FIG. 5.

Figure 2:
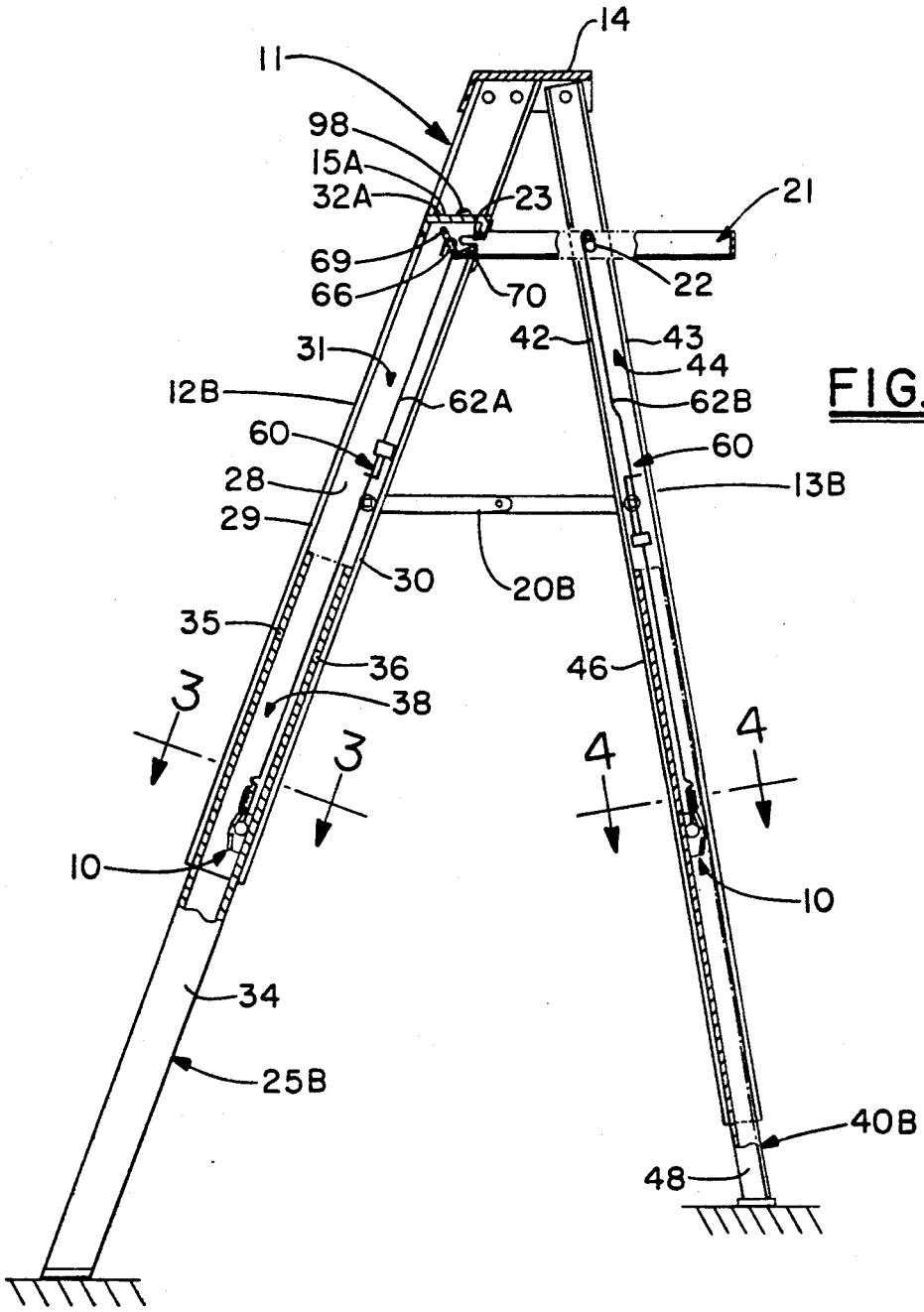
FIG. 2 is a sagittal cross section of the step ladder depicted in FIG. 1, with a portion of the extension legs which would normally be depicted in side elevation being shown in section.

With continued reference to FIGS. 6–8, while the ends 63A and 63B of the relative link arms 62A and 62B preferably engage the locking members 56A and 56B in such a manner as to permit rolling movement thereof, the other ends 64A and 64B of the respective link arms 62A and 62B are operatively interactive with an actuating member. For example, the ends 64A of link arms 62A may interact with the crank arms 66 by means of a pin-like fasteners 68 which will induce generally axial translation of the link arms 62A in response to rotation of the crank arms 66 about pivot pin 69. The pivot pin 69 may be mounted on the web wall 28 of the front support legs 12 just beneath step 15A, as shown in FIG. 2.

As will be more fully hereinafter explained, one means by which rotation of the crank arms 66 may be effected is by the pivotal movement of the bucket tray 21. Specifically, a trip arm 70 extends outwardly from the bucket tray 21 so that when the tray 21 is pivoted clockwise, as progressively indicated by the arrows in FIG. 7 and then FIG. 2, the trip arm 70 will contact an engaging bar 67 which extends laterally between the crank arms 66 and rotates them counterclockwise about pivot pin 69 to apply a tensile loading to the link arms 62A which will displace the link arms 62A, as well as locking members 56A attached thereto, axially through a predetermined distance, as will be hereinafter more fully discussed in conjunction with the explanation as to the operation of the locking mechanism 10 on a ladder 11.

That same pivotal movement of the bucket tray 21 also actuates the link arm 62B associated with each back support leg 13. With continued reference to FIGS. 2 and 6, one end 63B of each link arm 62B is operatively engaged with a locking member 56B, and the other end 64B of each link arm 62B is pivotally connected to the bucket tray 21 by a pin-like fastener 71 which extends outwardly from the bucket tray 21 in proximity to the pivot pin 22 by which the bucket tray 21 is mounted on the back support legs 13. The relationship of the fastener 71 to the pivot pin 22 is such that 90 degree rotation of the bucket tray 21 will result in that movement of the fastener 71 necessary to apply a tensile loading to link arms 62B which will displace the link arms 62B, as well as the locking members 56B attached thereto, axially through a predetermined distance which is preferably the same distance through which the link arms 62A are simultaneously displaced by the 90 degree rotation of the paint tray 21, as will also be hereinafter more fully discussed in conjunction with the explanation as to the operation of the locking mechanism 10 on a ladder 11.

Figure 11:
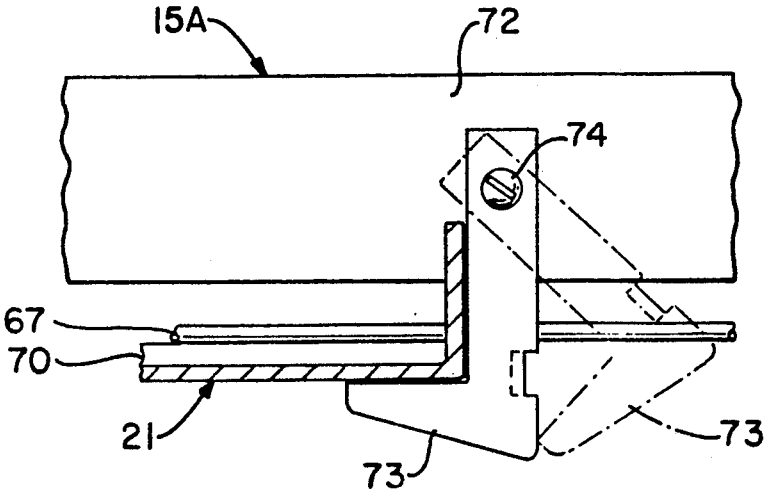

Mounted on the rear face 72 of the uppermost step 15A is a safety lock 73 (FIGS. 8 and 11). The safety lock 73 may be pivotally attached to the rear face 72 by means of fastener 74 which is typically a bolt and nut combination, but may well be a rivet, metal screw or other pivotal mounting means. The fastener 74 attaches the safety lock 73 such that it may pivot about the fastener 74 selectively to secure the bucket tray 21 in that position whereby the leg-locked mode, as represented in FIGS. 2 and 8, is accomplished, and as will also be hereinafter explained in the operational description.

As best seen in FIGS. 2 and 6 through 8, inclusive, a connector block 75 may be secured to the central portion of each link arm 62. A follower arm 76 extends outwardly from each connector block 75 to interact with an actuating lever 78 which is preferably presented from each of the articulating arms 20. Specifically, each of the articulating arms 20 may be pivotally mounted from the front and back support legs 12 and 13, as by bars 79A and 79B, respectively, which are affixed to the articulating arms 20 so as to rotate therewith and yet be rotatably supported from the respective front and back support legs 12 and 13. Each rotating bar 79 may incorporate a squared portion as best seen from FIGS. 1 and 6 through 8, and the actuating lever 78 may extend radially outwardly from a collar 80 that is affixed to the squared portion of the rotating bars 79 so as to rotate therewith and allow the actuating levers 78 operatively to engage the follower arms 76 in order to effect the desired movement of the link arms 62 in response to the pivotal movement of the rotating bars 79, as will be hereinafter more fully explained in conjunction with the description of the operation of the ladder 11.

Figure 10:
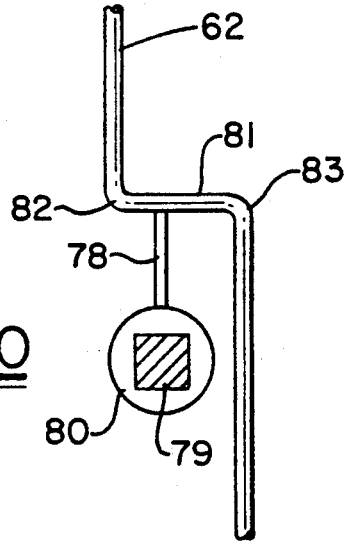
FIG. 10 is a side elevational view, partially in section, of an alternative arrangement by which a portion of a link arm employed by the present invention may be constructed; and, FIG. 11 is an enlarged, rear elevational view, partially in section, and taken substantially along line 11—11 of FIG. 8, depicting the interaction of a safety lock with the bucket tray to assure that the extension legs remain locked.

A structural arrangement which can be employed in lieu of the connector block 75 is the connector offset 81 depicted in FIG. 10. In the situation where the link arms 62 are fabricated from a material which permits the link arms 62 to be formed with two 90 degree bends 82 and 83 without denigrating the strength of the link arms 62—and with the assurance that the resulting connector offset 81 will be able to accept loads applied laterally thereagainst and transmit those loads as tensile or compressive forces into the link arms 62—the connector offset 81 can constitute an acceptable alternative to the connector block 75. The connector offset 81 interacts with the actuating lever 78 presented from the rotating bars 79 in the same manner heretofore described with respect to the connector block 75.

OPERATION

A locking mechanism 10 embodying the concepts of the present invention operates as follows. FIG. 6 represents the "storage mode". In the storage mode the bucket tray 21 is disposed in parallel relation to the back support legs 13 from which the tray 21 is pivotally mounted. The notch 23 on the trip arm 70 of the bucket tray 21 is, therefore, disengaged from the step 15A so that the crank arms 66 are free to move. In addition, the articulating arms 20 are folded such that the front and rear support legs 12 and 13 are disposed in generally parallel juxtaposition. With the articulating arms 20 so folded the actuating levers 78 are thus disengaged from the follower arms 76. In fact, the actuating levers 78 are angularly disposed such that they cannot make contact with the follower arms 76 irrespective of the degree to which the link arms 62 might axially translate.

In the storage mode a biasing means is preferably employed to prevent the extension legs 25 and 40 from protracting axially outwardly with respect to the respective support legs 12 and 13. As such, the biasing means also serves as an actuating means. With the link arms 62 being unrestricted by the crank arm 66 as well as the follower arm 76, the action of a biasing means which is operatively secured between each link arm 62 and the respective support leg 12 and 13 will effect a wedging engagement of the locking members 56 with their associated cam surface 50. As depicted, the biasing means may be in the nature of a tension spring 85, one end of each being operatively secured to the appropriate link arm 62, and the other end of which is anchored to the support legs 12 and 13. As shown, one end 86 of spring 85 engages a connecting offset 88 in the appropriate link arm 62, and the other end 89 of spring 85 may be anchored in an aperture 90 in the cam plate 53.

The tensile action of the spring 85 applies a compressive load on the link arm 62 with which it interacts to translate the link arm 62 under a compressive load and thereby drives the associated locking member 56 downwardly through a distance designated as $X_1$ in FIG. 6 and into wedging engagement with the cam surfaces 50 in the respective locking mechanisms 10A and 10B to the point where the locking members 56A and 56B each wedge one of the engaging plates (flange 36 on extension leg 25 and flange 46 on extension leg 40) against the appropriate reaction surface 49 (the inwardly directed surface on flange 30 of the front support leg 12 and the inwardly directed surface on flange 42 of the back support leg 13). This interaction of the locking member 56A with the front support leg 12 and the front extension leg 25 as well as the interaction of the locking member 56B with the back support leg 13 and the back extension leg 40 precludes the extension legs 25 and 40 from protracting outwardly from the respective support legs 12 and 13. In fact, any attempt for the extension legs 25 or 40 to protract more firmly drives the locking member 56 toward their opposed reaction surfaces 49 in order wedgingly to secure the engaging plates therebetween.

Nevertheless, the extension legs 25 and 40 can freely retract along their respective support legs 12 and 13 inasmuch as retracting movement of any extension leg allows the locking members 56 associated with that extension leg to move along the appropriate cam surfaces 50, thus relaxing the locking engagement of the engaging plate between the locking member 56 and the reaction surface 49. Even so, the biasing means 85 assures that the extension legs will be immediately resecured at any time that the protracting movement of the extension legs 25 and 40 along the respective support legs 12 and 13 stops. Accordingly, in the storage mode the locking mechanism 10 acts as a one-way lock because of the wedge-like action of the locking members 56.

To summarize the action of the locking mechanism 10 in the storage mode, if either, or both, of the extension legs 25 or 40 are forced upwardly along the respective support legs 12 or 13 (as would occur when the ladder 11 is being prepared for storage) that motion of the extension legs 25 or 40 would force the locking members 56 upwardly to decrease the binding effect of the locking members 56 against the engaging plates presented by the flanges 36 and 46 on the front and back extension legs 13. This allows the extension legs 25 and 40 to be retracted into the support legs 12 and 13 for ease of storage. However if the opposite movement of any extension leg 25 or 40 is attempted (such as by gravity's influence, which would tend to re-extend the leg whenever the ladder is lifted from the ground) the locking member 56 would be forced downwardly by the spring 85 to increase the binding effect of the locking members 56 against the cam surfaces 50. This prevents protraction of the extension legs 25 or 40. Thus, the storage mode allows retraction but precludes protraction of the extension legs 25 and 40 relative to the respective front and back support legs 12 and 13.

FIG. 7 represents the "leg-adjusting mode". In the leg-adjusting mode the bucket tray 21 remains disposed in parallel relation to the back support legs 13 from which the bucket tray 21 is pivotally mounted. Thus, the notch 23 on the trip arm 70 also remains disengaged from the step 15A so that the crank arm 66 is free to move, as in the storage mode. However, unlike the previously described storage mode the articulating arms 20 have been straightened from their folded position so that the front and back legs 12 and 13 diverge downwardly from the top support 14 in the disposition depicted in FIGS. 1 and 2. This is the disposition of the legs 12 and 13 when the ladder 11 is being used.

As the articulating arms 20 are straightened from their folded disposition (the disposition of the articulating arms in the storage mode) to the linear disposition depicted in the leg-adjusting mode, as represented schematically in FIG. 7, the actuating levers 78A and 78B are rotated with the bars 79A and 79B to engage the respective follower arms 76A and 76B and raise the respective link arms 62A and 62B, against the biasing action of springs 85, through the distance $X_2$. Distance $X_2$ is approximately the same as the previously described distance $X_1$, but in any event the distance $X_2$ is of such magnitude that the resulting axial displacement of the link arms 62 will raise the locking members 56A and 56B out of contact with the cam surfaces 50A and 50B but not so far as to bring the locking members into contact with the opposite cam surfaces 51A and 51B. As shown in FIG. 7, each locking member 56 is disposed between the apex 55 and the opposed reaction surface 49 so that the extension legs 25 and 40 are unrestricted in their axial movement along the respective front and back support legs 12 and 13. Because the bucket tray 21 remains parallel to the back support leg 13 the crank arm 66 doesn't impart any axial loading to the link arms 62, and the sole control to the axial disposition of the link arms 62 is the interaction of the actuating levers 78 with the follower arms 76. Hence, the locking mechanisms 10 are controlled solely by the articulating arms 20 acting as the actuating means for the linking mechanism 60. In the leg-adjusting mode, therefore, the extension legs 25 and 40 are individually free to protract and/or retract relative to the supporting legs 12 and 13 without restriction. For that reason the person using the ladder 11 can, when the ladder is in the leg-adjusting mode, manually level the top support 14 and the extension legs 25 and 40 will adjust to the surface, or terrain, upon which the ladder 11 is being used. When the extension legs 25 and 40 of the ladder 11 are properly extended the leg-locking mode is activated.

Before proceeding with a description of the leg-locking mode it should be noted that because the extension legs 25 and 40 are freely capable of translating axially along the support leg 12 and 13 in the leg-adjusting mode it is highly desirable to provide some means by which to assure that the extension legs 25 and 40 do not axially exit the support legs 12 or 13. Three different structural arrangements are depicted herein to achieve that result. With reference to FIG. 1, a stop 92 in the form of a knurled, flat head bolt is secured to the web wall 34 of the extension leg 25. The stop 92 will, therefore, engage the step surface 32C on step 15C to limit the extent to which the extension leg 25 can protract outwardly with respect to the support leg 12.

Similarly, a stop 93, also in the nature of a bolt, and also shown in FIG. 1, may be secured to the flange 48 of the extension leg 40. The stop 93 will engage the edge portion 45 of the horizontal brace 18C in order to limit the extent to which the extension leg 40 can protract outwardly with respect to the back support leg 13.

The third arrangement is depicted in FIG. 9 in conjunction with the alternative embodiment 110. Specifically, the axial separation of the dogleg spacing portions 95 and 96 on the engaging plate 157 serve to define the span to which the extension leg 125 can slide along the support leg 112. That is, engagement of the shelf 147 with the axially spaced dogleg spacing portions delineate the extent to which the extension leg 125 can move axially with respect to the support leg 112.

If desired, one may secure an eye ball spirit level 98 to one lateral side of the step surface 32A on step 15A where it is out of the way, but where it can be readily seen by one attempting to level the ladder 11. By centering the bubble in the spirit level 98 in a well known manner one can assure that the ladder 11 is properly disposed for safe usage.

When a user of the ladder 11 achieves the desired disposition of the extension legs 25 and 40 in the leg-adjusting mode, as previously described, the user of the ladder 11 effects the "leg-locking mode". FIG. 8 schematically represents the leg-locking mode. In the leg-locking mode the articulating arms 20 remain in the straightened position by which the leg-adjusting mode is effected. The bucket tray 21, however, is rotated clockwise through approximately 90 degrees, as shown by the arrow in FIG. 7, to the position depicted in FIG. 8. As the bucket tray 21 is so rotated the trip arm 70 actuates the engaging bar 67 to effect counterclockwise rotation of the crank arms 66 from the position depicted in FIG. 7 to the position depicted in FIG. 8. This rotation of the crank arm 66 applies a tensile load to the link arms 62 which further overcomes the biasing action of the springs 85 and axially translates the link arms 62 that additional amount $X_3$ to move the locking members 56 upwardly along the cam surfaces 51 so that the engaging plate (the flange 36 on extension leg 25 and the flange 46 on extension leg 40) is wedged between the locking member 56 and the reaction surface 49. With the components of the locking mechanism 10 so disposed the extension legs 25 and 40 are not only fixedly secured against retraction relative to the front and back support legs 12 and 13 but will also resist protraction. This condition is assured by activating the safety lock 73 to preclude the bucket tray 21 from rotating about pivot pin 22.

As such, because of the way in which the locking mechanism 10 operates, when weight is placed on the ladder 11 the wedge-like binding effect of the locking member 56 is increased. Accordingly, the force required to release the locking member 56 is not trivial so that the extended position of the extension legs 25 an 40 will not be altered by anything other than a positive change from the leg-locking mode to the leg-adjusting mode or even the storage mode; gravity alone can not protract, or retract, the extension legs beyond the position in which they were set by the user. This effect will prevent the ladder from altering its stance if it is bumped or jarred, unlike many of the prior art arrangements.

As should now be apparent, the present invention not only teaches that a ladder embodying the concepts of the present invention provides an improved locking mechanisms specifically adapted for ladders but also otherwise accomplishes the objects of the invention.

I claim:

1. In combination, a ladder having at least a pair of support legs with an extension leg carried by, and slidable axially along, each said support leg, a locking mechanism selectively to secure the independent axial position of each extension leg with respect to the support leg by which it is carried, said locking mechanism comprising:

at least one reaction surface presented from each support leg;

a pair of locking cam surfaces also presented from each support leg, said locking cam surfaces being disposed in opposition to each said reaction surface;

an engaging plate means presented from each said extension leg and being slidably interposed between one said reaction surface and the opposed locking cam surfaces;

a locking member operatively disposed between said engaging plate means and said locking cam surfaces;

said locking member being movable along at least one of said locking cam surfaces selectively to wedge said engaging plate means against said reaction surface and thereby secure said extension leg at the desired position along the axial extent of said support leg;

actuating means selectively to move said locking member along said locking cam surfaces.

2. A combination, as set forth in claim 1, wherein:

said pair of cam surfaces are inclined and diverge toward said reaction surface.

3. A combination, as set forth in claim 2, wherein:

said pair of cam surfaces are inclined at approximately seven degrees.

4. A combination, as set forth in claim 2, wherein:

each said cam surface is presented from a cam plate; and, a pair of said cam plates being presented from a mounting arm that is supported from each said support leg.

5. A combination, as set forth in claim 4, wherein:

a shelf extends outwardly from at least one pair of said cam plates;

each said shelf disposed in spaced relation, and in opposition, to said pair of cam plates;

said reaction surface is presented from said shelf; and, said engaging plate means is interposed between said reaction surface and said locking mechanism.

6. A combination, as set forth in claim 5, wherein:

said engaging plate means is secured to, and offset from, said extension leg.

7. A combination, as set forth in claim 6, wherein:

offset dogleg portions are connected between said engaging plate means and said extension legs to interact with said shelf and thereby determine the extent to which said extension leg can move axially with respect to said support leg.

8. A combination, as set forth in claim 1, wherein:
a link mechanism is operatively connected between said actuating means and said locking member;
said link mechanism is capable of transmitting at least tensile forces.

9. A combination, as set forth in claim 8, wherein:
said link mechanism is capable of transmitting compressive forces.

10. A combination, as set forth in claim 1, wherein:
said ladder has two front support legs and two back support legs which are aligned in pairs;
an extension leg carried by each said support leg and being axially slidable therealong;
articulating arms connected between each aligned pair of front and back support legs to serve as stabilizing means between said front and back support legs and also to serve as actuating means.

11. A combination, as set forth in claim 10, wherein:
a bucket tray is rotatably carried by said back support legs;
said bucket tray also serves as an actuating means.

12. A combination, as set forth in claim 11, wherein:
a biasing means is connected between said support legs;
said biasing means to serve as an additional actuating means.

13. A combination, as set forth in claim 12, wherein:
said biasing means effect translation of said link arms through a first distance and a first direction such that said extension legs can freely retract but are secured against protraction.

14. A combination, as set forth in claim 10, wherein:
actuating lever means are presented from said articulating arms;
follower means are presented from said link arms;
said follower means being disengaged from said actuating lever means when said articulating arms are folded to store the ladder in order to permit said extension legs to retract but not protract;
said follower means being engaged by said actuating lever means in response to straightening said articulating arms in order to prepare said ladder for use;
engagement of said follower means by said actuating lever means effecting translation of said link arms, and the locking members attached thereto, through a second distance and a second direction such that said extension legs can freely protract or retract with respect to said support legs.

15. A combination, as set forth in claim 14, wherein:
a bucket tray is rotatably carried by said back support legs;
said bucket tray also serves as an actuating means.

16. A combination, as set forth in claim 15, wherein:
a trip arm is presented from said bucket tray;
a crank arm is operatively connected to said linking mechanism;
said crank arm being engaged by said trip arm in response to rotation of said bucket tray in that direction which prepares said ladder for use;
engagement of said crank arm by said trip arm effecting translation of said link arms, and the locking members attached thereto, through a third distance and in said second direction which operates said locking mechanism such that said extension legs are fixedly secured against retraction and resist protraction with respect to said support legs.

17. A combination, as set forth in claim 16, wherein:
said pair of cam surfaces are inclined and diverge toward said reaction surface.

18. A combination, as set forth in claim 17, wherein:
said pair of cam surfaces are inclined at approximately seven degrees.

19. A combination, as set forth in claim 17, wherein:
each said cam surface is presented from a cam plate; and,
a pair of said cam plates being presented from a mounting arm that is supported from each said support leg.

20. A combination, as set forth in claim 19, wherein:
a shelf extends outwardly from at least one pair of said cam plates;
each said shelf disposed in spaced relation, and in opposition, to said pair of cam plates;
said reaction surface is presented from said shelf; and,
said engaging plate means is interposed between said reaction surface and said locking mechanism.

21. A combination, as set forth in claim 20, wherein:
said engaging plate means is secured to, and offset from, said extension leg.

22. A combination, as set forth in claim 21, wherein:
offset dogleg portions are connected between said engaging plate means and said extension legs to interact with said shelf and thereby determine the extent to which said extension leg can move axially with respect to said support leg.

23. A combination, as set forth in claim 14, further comprising:
means to determine when said ladder is level.

24. A combination, as set forth in claim 23, wherein:
said determining means is an eye ball spirit level.

* * * * *